US012359393B2

(12) United States Patent
Tanaka et al.

(10) Patent No.: US 12,359,393 B2
(45) Date of Patent: Jul. 15, 2025

(54) SYSTEM AND METHOD TO SUPPORT ROTATION OPERATION OF WORK TOOL

(71) Applicant: Caterpillar SARL, Geneva (CH)

(72) Inventors: Kensuke Tanaka, Akashi (JP); Yoshitaka Nishizaki, Kobe (JP)

(73) Assignee: Caterpillar SARL, Geneva (CH)

( * ) Notice: Subject to any disclaimer, the term of this patent is extended or adjusted under 35 U.S.C. 154(b) by 906 days.

(21) Appl. No.: 17/531,802

(22) Filed: Nov. 22, 2021

(65) Prior Publication Data

US 2023/0160171 A1 May 25, 2023

(51) Int. Cl.
*E02F 3/00* (2006.01)
*E02F 3/36* (2006.01)
*E02F 9/20* (2006.01)

(52) U.S. Cl.
CPC ..... *E02F 3/3609* (2013.01); *E02F 3/3681* (2013.01); *E02F 9/2004* (2013.01)

(58) Field of Classification Search
CPC ..... E02F 9/2012; E02F 9/2008; E02F 9/2004; E02F 3/3681; E02F 3/3609
See application file for complete search history.

(56) References Cited

U.S. PATENT DOCUMENTS 5,575,093 A 11/1996 Pratt et al.
9,976,277 B2 5/2018 van Amelsfoort
10,202,740 B2 2/2019 Stockhaus et al.
2009/0158625 A1 6/2009 Pope et al.
2021/0095441 A1 4/2021 Jonsson
2022/0412050 A1* 12/2022 Hoaby ..... E02F 9/2012
2024/0117608 A1* 4/2024 Shobe ..... E02F 9/264
2024/0208327 A1* 6/2024 Wataya ..... G05G 9/047

FOREIGN PATENT DOCUMENTS

GB 2591254 7/2021
JP 8-20975 A 1/1996
JP 10-280485 A 10/1998
JP 11-152767 A 6/1999
JP 2020-180513 A 11/2020
JP 2021-17711 A 2/2021
WO 2014/168540 A1 10/2014

OTHER PUBLICATIONS

European Extended Search Report for Europe Patent Appln. No. 22205072.6, mailed Apr. 12, 2023 (5 pgs).

* cited by examiner

*Primary Examiner* — Steven O Douglas

(57) ABSTRACT

A work machine comprises a tilt rotator to control rotation of a tool, a coupler to couple and decouple the tool to/from the tilt rotator, a display to output information to an operator of the work machine, an operator interface to receive input from the operator, and processing circuitry. The processing circuitry is configured to output, on the display, a rotation instruction for the operator to initiate a rotation operation of the tilt rotator, in a case that the tilt rotator is determined to be in an incorrect position, stop the rotation operation of the tilt rotator under a condition that the tilt rotator is determined to be in a correct position based on a rotation angle of the tilt rotator about a rotational axis, the rotation operation being initiated by a rotation input via the operator interface.

20 Claims, 8 Drawing Sheets

SYSTEM AND METHOD TO SUPPORT ROTATION OPERATION OF WORK TOOL

TECHNICAL FIELD

The present disclosure relates to work machines, and more particularly to construction machines equipped with a tilt rotator and a quick coupler, and systems, assemblies, and methods thereof.

BACKGROUND

Work machines, particularly those in construction, mining, earth moving, goods handling, forestry, agriculture, or other such industries, typically utilize a tool controlled by an operator to perform work. A variety of tools may be attached to an arm arrangement of a multipurpose machine via a coupling arrangement for performing different types of work.

The coupling arrangement may comprise a quick coupler, which can allow coupling and decoupling between a tool and the work machine in a particularly efficient and quick operation. The quick coupler typically may be controlled by an operator from a cabin of the work machine via a control system and associated actuators. The coupling arrangement may further comprise a tilt rotator, which can enable controlled rotation of the tool about a rotational axis and controlled tilt of the tool relative to a tilt axis. By way of the tilt rotator, flexible movement of the tool can be provided during operation of the work machine.

To safely attach the tool to the quick coupler or detach the tool from the quick coupler, it may be required to arrange the tilt rotator and the tool in an appropriate position during attachment or detachment of the tool.

U.S. Published Patent Document US2021/0095441A1 ("the US '441 Publication") describes an excavator provided with a tilt rotator and an excavator thumb, which may be pivotally attached to an arm of the excavator. According to the US '441 Publication, a control system may be arranged to block maneuvering input for movement of at least one of the tilt rotator and the excavator thumb to reduce a risk of damaging the equipment. Also, the US '441 Publication describes a quick command to put a tool in a correct position for cooperation with the excavator thumb.

However, for safety during attachment/detachment of the tool, it has been desired to be able to control a series of processing of rotation operation of the tilt rotator and rollup operation of the tool by guiding the operator's operation appropriately, in addition to automatically performed operation.

SUMMARY

According to an aspect a work machine is described or provided. The work machine can comprise a tilt rotator to control rotation of a tool about a rotational axis and to control tilt of the tool about a tilt axis, a coupler to couple and decouple the tool to/from the tilt rotator, a display to output information to an operator of the work machine, an operator interface to receive input from the operator, and processing circuitry. The processing circuitry is configured to output, on the display, a rotation instruction for the operator to initiate a rotation operation of the tilt rotator, in a case that the tilt rotator is determined to be in an incorrect position based on a rotation angle of the tilt rotator about the rotational axis, stop the rotation operation of the tilt rotator under a condition that the tilt rotator is determined to be in a correct position based on the rotation angle of the tilt rotator about the rotational axis, the rotation operation being initiated by a rotation input via the operator interface, output, on the display, a rollup instruction for the tool to initiate a rollup operation.

In another aspect, a method for a work machine is disclosed or implemented. The method can comprise detecting a rotation angle of a tilt rotator, the tilt rotator controlling rotation of a tool about a rotational axis and controlling tilt of the tool about a tilt axis; outputting, on the display, a rotation instruction for the operator to initiate a rotation operation of the tilt rotator, in a case that the tilt rotator is determined to be in an incorrect position based on a rotation angle of the tilt rotator about the rotational axis; and stopping the rotation operation of the tilt rotator under a condition that the tilt rotator is determined to be in a correct position based on the rotation angle of the tilt rotator about the rotational axis, the rotation operation being initiated by a rotation input via the operator interface.

And in another aspect a control system is disclosed or provided. The control system can comprise circuitry configured to detect a rotation angle of a tilt rotator, the tilt rotator controlling rotation of a tool about a rotational axis and controlling tilt of the tool about a tilt axis, output rotation instruction of the tilt rotator on a display, in a case that the tilt rotator is determined to be in an incorrect position based on the rotation angle of the tilt rotator, detect rotation operation of the tilt rotator, in response to a rotation input via an operator interface, automatically stop the rotation operation of the tilt rotator in a case that the tilt rotator is determined to be in a correct position based on the rotation angle of the tilt rotator, and output rollup instruction of the tool on the display.

Other features and aspects of this disclosure will be apparent from the following description and the accompanying drawings.

DETAILED DESCRIPTION

The present disclosure relates to work machines, and more particularly to construction machines equipped with a tilt rotator and a quick coupler, and systems, assemblies, and methods thereof. Generally, embodiments of the disclosed subject matter can implement the work machine that can guide an operator to control rotation operation of the tilt rotator until the machine detects a correct position of the tilt rotator, and/or that can guide the operator to control rollup operation of the tool, for instance, to avoid an unsafe condition during the attachment/detachment of the tool.

Figure 1:
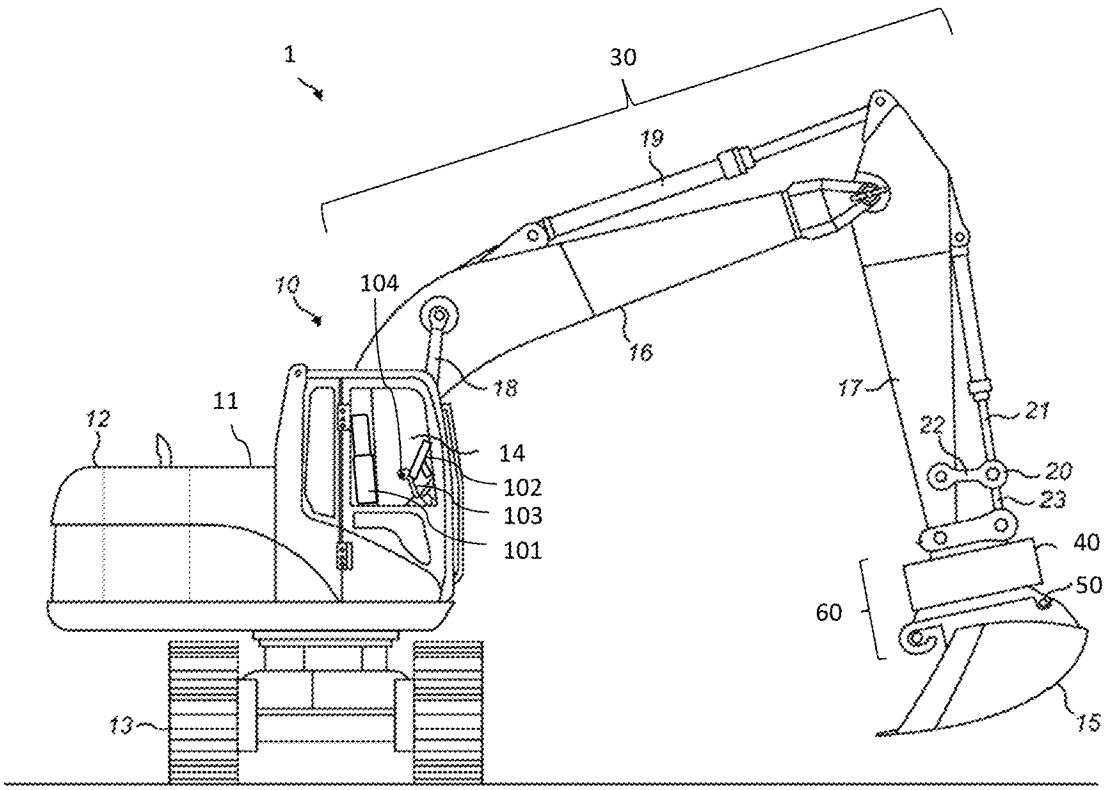
FIG. 1 is a side elevational view of a work machine according to one or more embodiments of the disclosed subject matter.

Turning to the figures, FIG. 1 is a side elevational view of a work machine according to one or more embodiments of the disclosed subject matter. The work machine 1 may comprise a body 10 and an arm arrangement 30 to which a tool 15 may be connected via a coupling arrangement 60.

The body 10 of the work machine 1 can be or include a chassis, frame, and exterior panels of the work machine 1 and can be configured to support and house various components of the work machine 1, such as an engine 11, a pump 12, tracks 13, and a cabin 14.

The engine 11 can be a combustion, electric, or other type of engine configured to produce mechanical energy. The pump 12 can be a hydraulic pump connected to the engine 11 and can be powered thereby. In some examples, the pump 12 can be connected to one or more valves for controlling and distributing hydraulic fluid to various hydraulic actuators of the work machine 1, such as a first hydraulic actuator 18, a second hydraulic actuator 19, and a third hydraulic actuator 21. The tracks 13 can be a set of movable tracks powered by the engine 11 and connected to the body. The tracks 13 can be operable by the engine 11 to move the work machine.

The cabin 14 can be connected to the body 10 and configured to enclose an operator therein. For example, the cabin 14 can include an operator's seat 101, a monitor 102, an operator interface 103 (e.g., an operation lever such as a joystick) and a control system for controlling the operation of the engine 11, the pump 12, the tracks 13, and the arm arrangement 30 and the coupling arrangement 60 to control the tool 15 (e.g., a bucket). In the embodiment, the operator of the work machine 1 can receive information shown on the monitor 102 and appropriately control the work machine 1 by the operator interface 103, for instance, a switch 104 which may be mounted on the operator interface 103. The switch 104 on the operator interface 103, as used herein, can include only one switch or multiple switches. The cabin 14 may further comprise foot pedals and one or more switches arranged inside cabin 14 to control the work machine 1. The detail of the control system will be described with reference to FIG. 5.

The arm arrangement 30 may comprise a boom 16, which may be referred as a first arm, pivotally attached to the body 10, and a stick 17, which may be referred as a second arm, pivotally attached to the boom 16. The boom 16 can be connected to the body 10 and the stick 17, and the stick 17 can further be connected to the coupling arrangement 60. Each of the first hydraulic actuator 18, the second hydraulic actuator 19, and the third hydraulic actuator 21 can be connected to and powered by the pump 12, as noted above. The first hydraulic actuator 18 can be connected to the body 10 and the boom 16; the second hydraulic actuator 19 can be connected to the boom 16 and the stick 17; and the third hydraulic actuator 21 can be connected to the stick 17 and the coupling arrangement 60.

The arm arrangement 30 may also comprise a linkage arrangement 20, which may enable the coupling arrangement 60 to be pivotally attached to the arm arrangement 30, particularly to the stick 17. The third hydraulic actuator 21 may be connected between the stick 17 and linkage arrangement 20 to pivot the linkage arrangement 20 and the coupling arrangement 60 relative to the stick 17. The linkage arrangement 20 may comprise at least one first link 22 pivotally attached to the third hydraulic actuator 21 and the stick 17. The linkage arrangement 20 may comprise at least one second link 23 pivotally attached to the coupling arrangement 60 and pivotally attached to the third hydraulic actuator 21 and at least one first link 22.

The coupling arrangement 60 may comprise the tilt rotator 40 and a quick coupler 50 to couple the tool 15 of the work machine 1 at one end. The quick coupler 50 may be an assembly to easily couple an attachment (e.g., the tool 15) without using a conventional fastening member (e.g., bolt), for shortening replacement time required for replacing the attachment. The arrangement of the tilt rotator 40 and the quick coupler 50 will be described with reference to FIG. 2.

The tool 15 may be attached to the arm arrangement 30 of the work machine 1 via the coupling arrangement 60 for performing various types of work. It is noted that embodiments of the disclosed subject matter are not limited to a bucket as the tool 15 as shown in FIG. 1. For instance, embodiments of the disclosed subject matter can include any other suitable accessories or tools than a bucket, such as such as a fork, hammer, plow, handling arm, multi-processor, pulveriser, saw, shears, blower, grinder, tiller, compactor, trencher, winch, auger, blade, broom, cutter, planer, delimber, felling head, grapple, mulcher, ripper, or the like.

In operation of some examples, an operator can use the controls within the cabin 14 to move the work machine 1 using the tracks 13. The operator can further articulate the boom 16 and the stick 17 to position the tool 15 relative to the body 10. The operator can control to use the tilt rotator 40 to tilt, rotate, and scoop or curl the tool 15 to perform various tasks, such as moving dirt and other materials during an excavating process.

Figure 2:
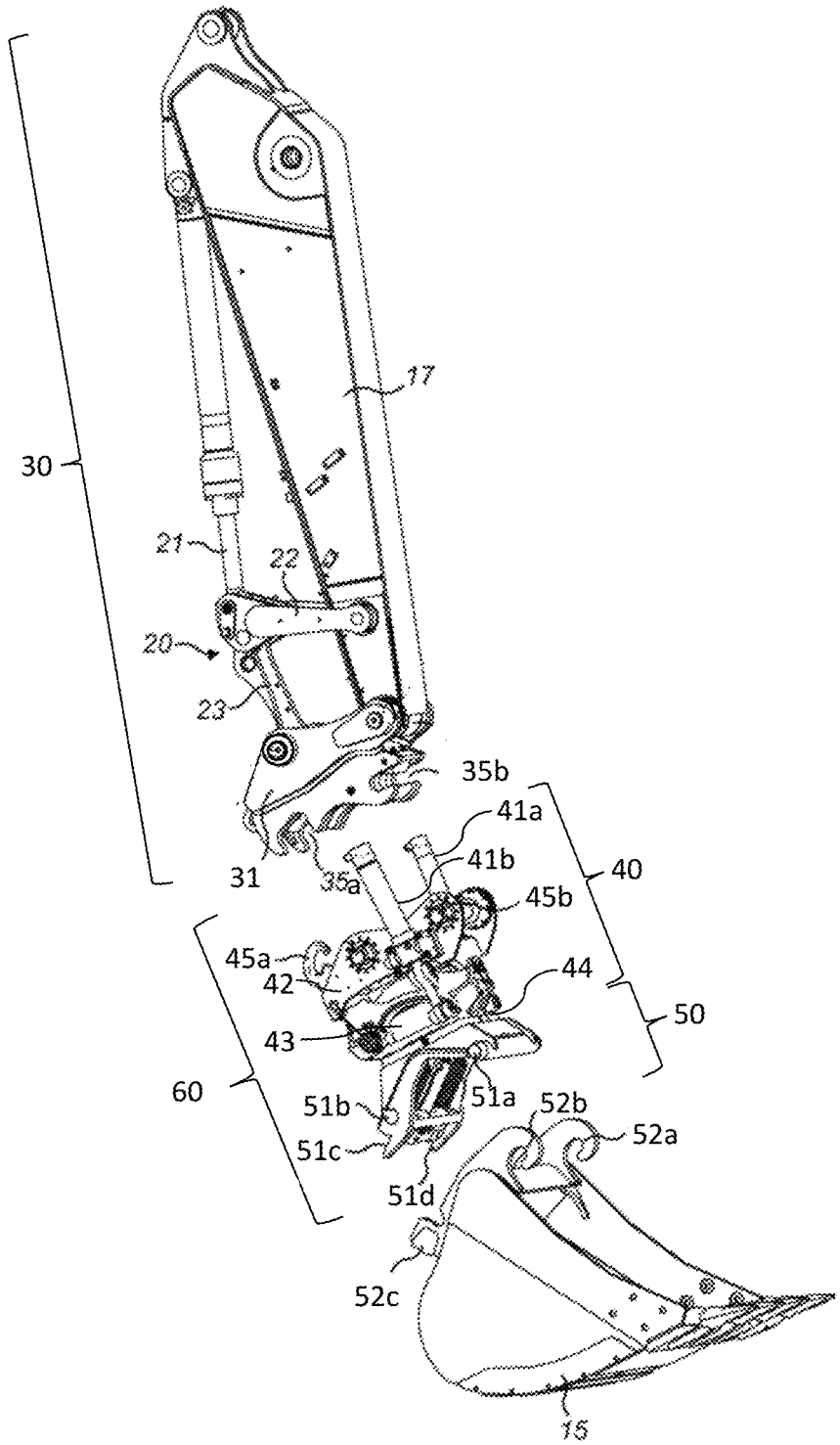
FIG. 2 is an exploded perspective view of a coupling arrangement comprising a tilt rotator and a quick coupler of the work machine of FIG. 1 according to one or more embodiments of the disclosed subject matter.

FIG. 2 is an exploded perspective view of a coupling arrangement comprising the tilt rotator 40 and the quick coupler 50 of the work machine of FIG. 1 according to one or more embodiments of the disclosed subject matter. As shown in FIG. 2, the coupling arrangement 60 may comprise the tilt rotator 40 and the quick coupler 50 coupled to the lower end of the tilt rotator 40. The lower end of the tilt rotator 40 may comprise a rotatable manipulator table 44, to which the quick coupler 50 can be fastened. The tilt rotator 40 may further comprise tilting cylinders 41*a* and 41*b* to tilt the quick coupler 50 up to a predetermined angle (e.g., 40 degrees). The tilt rotator 40 may further comprise a rotating actuator 43 to actuate the rotatable manipulator table 44 about a predefined range (e.g., 360 degrees), for example by hydraulic power.

The tilt rotator 40 may comprise an upper attachment part 42 to hold interaction with an upper fastening part 31 of the arm arrangement 30, which can be attached to the end of the stick 17. The upper attachment part 42 may comprise at least one intermediate coupling element 45 corresponding to at least one first coupling element 35 of the upper fastening part 31 of the arm arrangement 30. As one embodiment of the subject matter, FIG. 2 shows that the upper attachment part 42 can comprise intermediate coupling elements 45*a* and 45*b* each corresponding to first coupling elements 35*a* and 35*b* of the upper fastening part 31, respectively.

The upper fastening part 31 and the upper attachment part 42 may be configured to selectively engage the first and intermediate coupling elements 35*a*, 35*b*, 45*a*, 45*b*, so as to couple the arm arrangement 30 to the coupling arrangement 60.

As is evident from FIG. 2, at least one of the intermediate coupling elements 45*a* and 45*b* of the upper attachment part 42 of the tilt rotator 40 may be an attachment pin, wherein the at least one of the intermediate coupling elements 45*a* and 45*b* can be arranged to fit in a corresponding recess provided by at least one of the first coupling elements 35*a* and 35*b* of the upper fastening part 31. In the corresponding way, the quick coupler 50 of the coupling arrangement 60 may comprise at least one second coupling element 51 (e.g., an attachment pin) to attach and detach the tool 15. The tool 15 may comprise at least one tool coupling element 52 (e.g., a recess) to be selectively connected with the at least one second coupling element 51. As one embodiment of the subject matter, FIG. 2 shows that the quick coupler 50 can comprise the second coupling elements 51*a*, 51*b*, 51*c* and 51*d* corresponding to the tool coupling elements 52*a*, 52*b* and 52*c* of the tool 15.

In particular, the quick coupler 50 may comprise at least one locking actuator to selectively engage the at least one second coupling element 51 with the at least one tool coupling element 52. For example, the at least one locking actuator may be configured to extend or retract the pin provided by the second coupling element 51, from the recess provided by the tool coupling element 52. The pin may be spring biased into the extended orientation. The locking actuator may comprise an electric actuator, such as an electronically activated solenoid, and/or a hydraulic actuator, such as a piston and cylinder. The at least one second coupling elements 51 and at least one tool coupling element 52 may be of any other suitable type known in the art and may, for example, comprise at least one wedge, pin, hook or the like. Some of the at least one second coupling elements 51 and at least one tool coupling element 52 may be configured to only provide support during coupling and are not actuatable. For example, one or more of the at least one second coupling elements 51 and at least one tool coupling element 52 may comprise corresponding fixed pin(s) or wedge(s) and support recess(es) or mount(s).

In this embodiment, by the at least one locking actuator of the quick coupler 50 and a locking attachment (e.g., spring), the tool 15 can be coupled to the tilt rotator 60 in a lock state so that the locking actuator (e.g., cylinder) cannot move by unintentional cause. On the other hand, the quick coupler 50 can be unlocked by releasing the locking attachment from the at least one locking actuator of the quick coupler 50, and the tool 15 may be detachable when the quick coupler 50 is unlocked (i.e., in an unlock state). The transition between the lock state and the unlock state of the quick coupler 50 may be controlled by the control system which will be described with reference to FIG. 5.

It is noted that embodiments of the disclosed subject matter are not limited to the specific arrangement of the coupling elements as shown in FIG. 2. For instance, embodiments of the disclosed subject matter can include more or less coupling elements to engage the quick coupler 50 and the tool 15.

Here, when the work machine 1 attaches or detaches the tool 15 to or from the quick coupler 50, the position of the tool 15 relative to the work machine 1 may be regulated by a certain rule (or rules) in a work area. For example, in North America, it may be regulated that the tool 15 should be faced the front surface of the body 10 of the work machine 1 without rotation angles or tilt angles by the tilt rotator 40 and curled up, when the tool 15 is attached to and/or detached from the quick coupler 50. In that area, if the tool 15 is detached from the quick coupler 50 in an incomplete state (e.g., the tool 15 is rotated and/or tilted, i.e., offset from the correct position(s)), it may cause unsafe condition, such as an unexpected fall of the tool 15 from the quick coupler 50.

On the other hand, it may be hard for the operator of the work machine 1 to stop the tilt rotator 40 in the correct position completely by a manual maneuvering operation. Therefore, an appropriate support by the work machine 1 to the operator to control the tilt rotator 40 in the correct position may be desired.

Figure 3B:
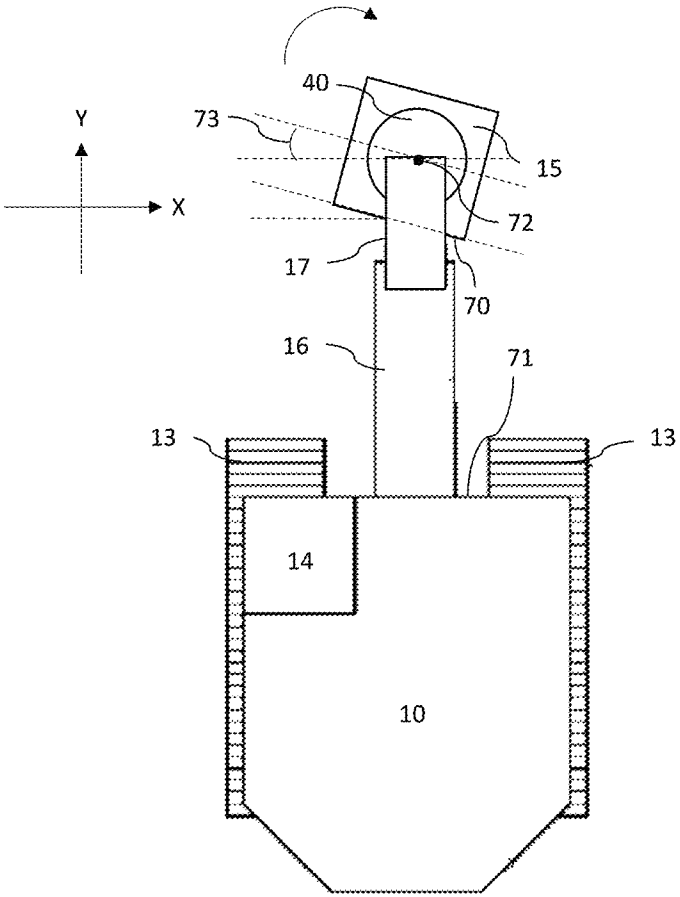
FIGS. 3A and 3B show top plan views of the work machine of FIG. 1 according to one or more embodiments of the disclosed subject matter.
Figure 3A:
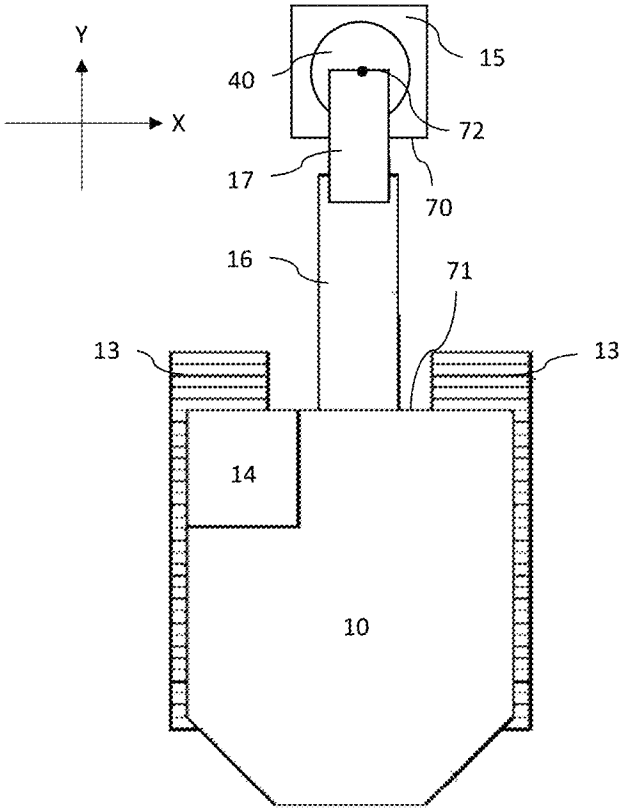

Turning now to FIGS. 3A and 3B, FIGS. 3A and 3B show a top plan view of the work machine 1 according to one or more embodiments of the disclosed subject matter.

FIG. 3A shows the top plan view of the work machine 1 when the tilt rotator 40 is in the correct position (about a rotational axis 72). More specifically, in the correct position, a tool vertical reference plane (i.e., a face 70 of the tool 15) may face a front surface 71 of the body 10 of the work machine 1 as shown in FIG. 3A. For instance, the face 70 of the tool 15 and the front surface 71 of the body 10 of the work machine 1 may be in parallel without any rotation angles with respect to the rotational axis 72 in a plane which is given by X- and Y-coordinates as shown in FIG. 3A.

Alternatively, in case that the front surface 71 of the body 10 of the work machine 1 may not be straight, the correct position of the tool 15 in the top plan view may be defined by the face 70 of the tool 15 being orthogonal to a forward running direction of the work machine 1, or the face 70 of the tool 15 may be perpendicular to the boom 16 of the work machine 1.

Optionally or alternatively, in case that the face 70 of the tool 15 may not be straight, the tool vertical reference plane may be defined with other values, such as reference values of coordinates in the X- and Y-coordinates.

FIG. 3B shows the top plan view of the work machine 1 when the tilt rotator 40 is in a rotated position, i.e., an incorrect position (about the rotational axis 72, for instance, offset from a predetermined rotation angle). More specifically, in FIG. 3B, the face 70 of the tool 15 can be rotated with respect to the rotational axis 72 at a rotation angle 73. In other words, the rotation angle 73 may be an angle between the face 70 of the tool 15 and the front surface 71 of the body 10 of the work machine 1 in the plane which is given by X- and Y-coordinates as shown in FIG. 3B. In the embodiment, the rotation angle 73 can be implemented as 360 degrees.

Alternatively, in case that the front surface 71 of the body 10 of the work machine 1 may not be straight, the rotation angle 73 can be defined as the angle rotated from a plane which may be orthogonal to a forward running direction of the work machine 1, or a plane may be perpendicular to the boom 16 of the work machine 1, in the top plan view of the work machine 1.

In this embodiment, the rotated position of the tilt rotator 40 about the rotational axis 72 as shown in FIG. 3B may be determined as the incorrect position, for example, which is not suitable for a bucket close/curl operation in case that the tool 15 is a bucket, since the bucket does not face the front of the work machine 1.

Optionally or alternatively, the correct position of the tilt rotator 40 in the top plan view of the work machine 1 can be defined as a range of the rotational angle 73 which is less than a predetermined threshold value. In that case, the incorrect position of the tilt rotator 40 in the top plan view of the work machine 1 may be defined as a range of the rotational angle 73 which is equal to or larger than the predetermined threshold value.

Figure 4A:
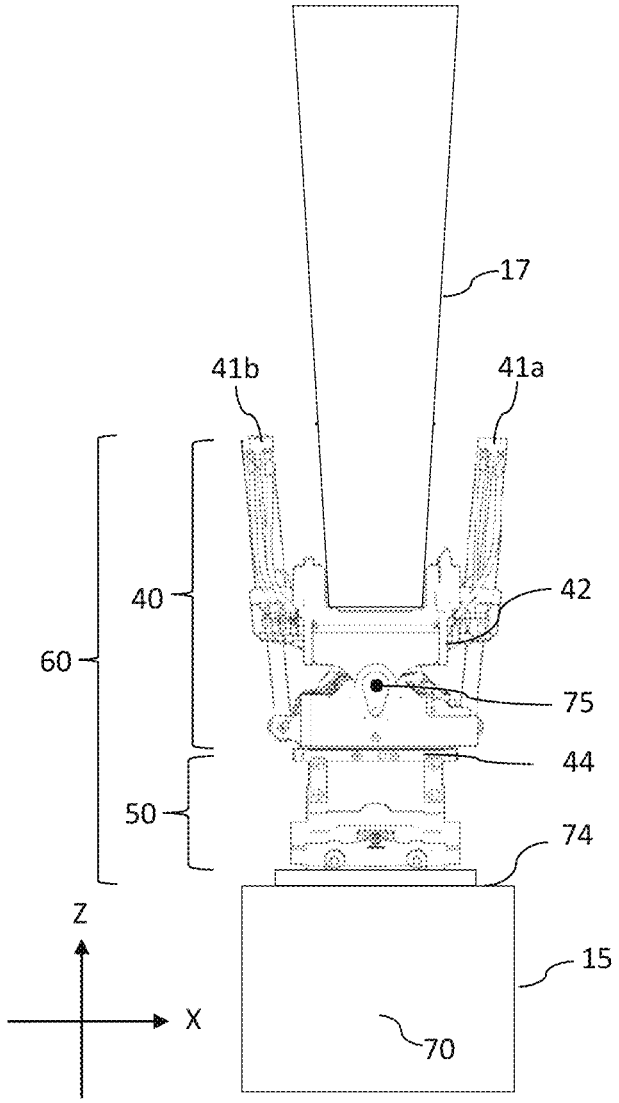
FIGS. 4A and 4B show front elevational views of the coupling arrangement from a cabin of the work machine according to one or more embodiments of the disclosed subject matter.
Figure 4B:
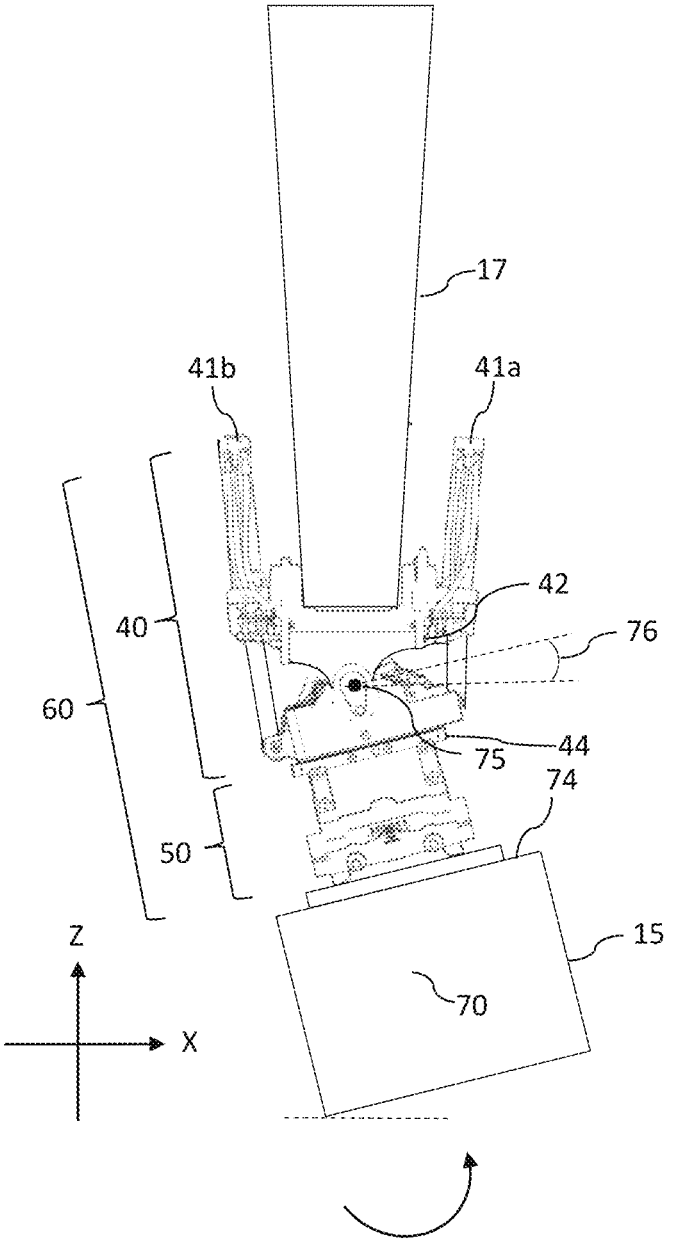

Turning now to FIGS. 4A and 4B, FIGS. 4A and 4B show a front elevational view of the coupling arrangement 60 from the cabin 14 of the work machine 1 according to one or more embodiments of the disclosed subject matter. In both of FIGS. 4A and 4B, the tool 15 may be arranged in the correct position in the top plan view of the work machine 1 as FIG. 3A, so the face 70 of the tool 15 may face the front surface 71 of the body 10 of the work machine 1. Alternatively, in case that the front surface 71 of the body 10 of the work machine 1 may not be straight, the face 70 of the tool 15 may be orthogonal to a forward running direction of the work machine 1, or the face 70 of the tool 15 may be perpendicular to the boom 16 of the work machine 1.

FIG. 4A shows the front elevational view of the coupling arrangement 60 from the cabin 14 of the work machine 1 when the tilt rotator 40 is in the correct position (about a tilt axis 75). For instance, in the correct position in the front elevational view of the coupling arrangement 60 from the cabin 14 of the work machine 1, a tool horizontal reference plane (e.g., a top surface 74 of the tool 15) may be parallel to the ground without any tilt angles with respect to the tilt axis 75 in a plane which is given by X- and Z-coordinates as shown in FIG. 4A.

Optionally or alternatively, in case that the top surface 74 of the tool 15 may not be straight, the tool horizontal reference plane may be defined with other values, such as a surface of the rotatable manipulator table 44, or reference values of coordinates in the X- and Z-coordinates.

FIG. 4B shows the front elevational view of the coupling arrangement 60 from the cabin 14 of the work machine 1 when the tilt rotator 40 is in the tilted position, i.e., an incorrect position (about the tilt axis 75, for instance, offset from a predetermined tilt angle). More specifically, in FIG. 4B, the top surface 74 of the tool 15 can be tilted with respect to the tilt axis 75 at a tilt angle 76. In other words, the tilt angle 76 may be an angle of the top surface 74 of the tool 15 from a horizontal plane may in the plane which is given by X- and Z-coordinates as shown in FIG. 4B. In the embodiment, the tilt angle 76 can be implemented as 40 degrees at maximum in each side of the tilt rotator 40.

It is noted that embodiments of the disclosed subject matter are not limited to the specific arrangement of the tilt angle 76 as shown in FIG. 4B. For instance, embodiments of the disclosed subject matter can arrange the tilt angle 76 in different values based on the type of the tool 15.

Alternatively, in case that the ground may not be straight, the tilt angle 76 can be defined as the angle tilted from a plane which may be parallel to a horizontal direction, or a plane may be parallel to a bottom surface of the stick 17 of the work machine 1, in the front elevational view of the coupling arrangement 60 from the cabin 14 of the work machine 1.

Optionally or alternatively, the correct position of the tilt rotator 40 in the front elevational view of the coupling arrangement 60 can be defined as a range of the tilt angle 76 which is equal to or less than a predetermined threshold value. In that case, the incorrect position of the tilt rotator 40 in the front elevational view of the coupling arrangement 60 may be defined as a range of the tilt angle 76 which is larger than the predetermined threshold value.

Figure 5:
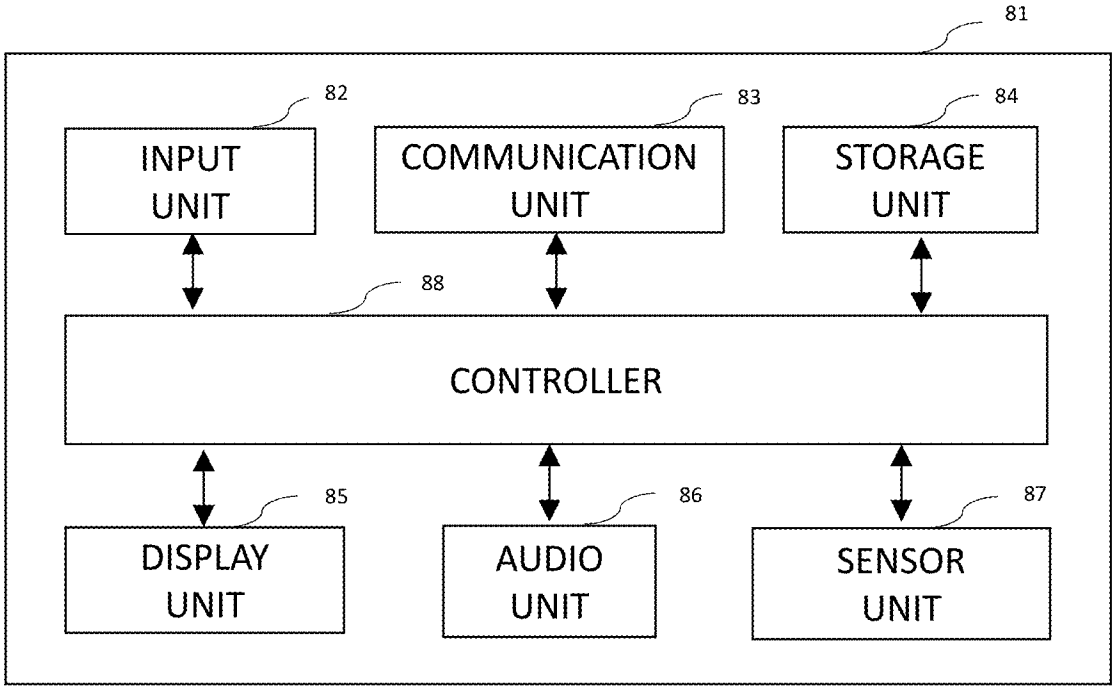
FIG. 5 is a block diagram illustrating a configuration of an information processing or control system according to embodiments of the disclosed subject matter.

Turning now to FIG. 5, FIG. 5 shows a block diagram illustrating a configuration of an information processing system 81 of the work machine 1 according to one or more embodiments of the disclosed subject matter. As illustrated in FIG. 5, the information processing system 81 can include an input unit 82, a communication unit 83, a storage unit 84, a display unit 85, an audio unit 86, a sensor unit 87, and a controller 88. Controller 88, as used herein, can include only one controller or multiple controllers.

The input unit 82 can have a function of receiving an input of operation information from a user of the information processing system 81. In this embodiment, for example, the input unit 82 can be implemented as the operator interface 103, the switch 104 on the operator interface 103, a touch panel of the monitor 102, foot pedals, other switches and a keyboard arranged in the cabin 14 shown in FIG. 1. For instance, the input unit 82 can receive input information of rotation operation of the tilt rotator 40 provided by the operator, via the switch 104, and transmit the input information to the controller 88. Also, the input unit 82 can receive input information of attachment/detachment of the tool 15 from the quick coupler 50 provided by the operator, via the switch 104 or the other switches, and transmit the input information to the controller 88.

The communication unit 83 can have a communication interface that has a function as a transmitter and a receiver performing communication with an external apparatus, on the basis of the control from the controller 88. In this embodiment, the communication unit 83 can be configured using a communication device such as a local CAN, a wired or wireless LAN, a communication card for Bluetooth, a router for communication, and a modem for communication.

The storage unit 84 can have a function of storing a variety of information used by the controller 88. For example, the storage unit 84 can store position information of the tilt rotator 40, such as the rotation angle and/or the tilt angle, and input information acquired by the input unit 82. The storage unit 84 also can store a predetermined rotation angle and/or a predetermined tilt angle for comparison to the rotation angle and/or the tilt angle of the movement of the tilt rotator 40. The storage unit 84 can be configured using a storage device such as a magnetic storage device, a semiconductor storage device, and an optical storage device.

The display unit 85 can have a function of displaying a variety of information, on the basis of control from the controller 88. For example, the display unit 85 can display the input information acquired by the input unit 82, and guidance information or a message to guide the operator to execute a certain operation of the work machine 1. The display unit 85 can be configured using a display device such as a liquid crystal display, a plasma display, and an organic EL display. The display unit 85 can be implemented as the monitor 102 and can be equipped with a touch panel to input information to the controller 88. Optionally, the display unit 85 can display virtual movements of the arm arrangement 30, the coupling arrangement 60 and the tool 15 in 3D space in synchronization with real-time-time movements of the arm arrangement 30, the coupling arrangement 60 and the tool 15. In this embodiment, optionally, the display unit 85 can display indication that may include or be part of instruction to the operator of the work machine 1 to initiate the rotation operation and/or the rollup operation.

The audio unit 86 can have a function of outputting sound based on control from the controller 88. In this embodiment, the audio unit 86 can be implemented as a horn or a speaker of the work machine 1. In this embodiment, optionally, the audio unit 86 can output sound that may include or be part of instruction to the operator of the work machine 1 to initiate the rotation operation and/or the rollup operation.

The sensor unit 87 can detect various information of the work machine 1. For example, a triaxial acceleration sensor (including an acceleration sensor, a gravity detection sensor, and a fall detection sensor) or a triaxial gyro sensor (including an angular velocity sensor, and a geomagnetic sensor) can be used as the sensor unit 87. In this embodiment, the sensor unit 87 can detect the rotation angle 73 and the tilt angle 76 of the tilt rotator 40 shown in FIGS. 3B and 4B.

The controller 88 can have a function of controlling an entire operation of the information processing system 81 (i.e., the work machine 1). For example, the controller 88 can control the operation of the work machine 1, on the basis of the operation information output from the input unit 82. The controller 88 can include a CPU, a ROM, and a RAM.

In an exemplary implementation, information processing system 81 of the work machine 1, or portions thereof, can be implemented using circuitry or processing circuitry that can include general purpose processors, special purpose processors, integrated circuits, ASICs ("Application Specific Integrated Circuits"), CPU (a Central Processing Unit), a micro processing unit (MPU), conventional circuitry and/or combinations thereof which are configured or programmed to perform the disclosed functionality. Processors can be considered processing circuitry or circuitry as they include transistors and other circuitry therein. The processor may be a programmed processor which executes a program stored in a memory. In the disclosure, the circuitry, units, or means can be hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units can be a combination of hardware and software, the software being used to configure the hardware and/or processor.

INDUSTRIAL APPLICABILITY

As noted above, the present disclosure relates to work machines, and more particularly to construction machines equipped with a tilt rotator and a quick coupler, and systems, assemblies, and methods thereof.

Figure 6:
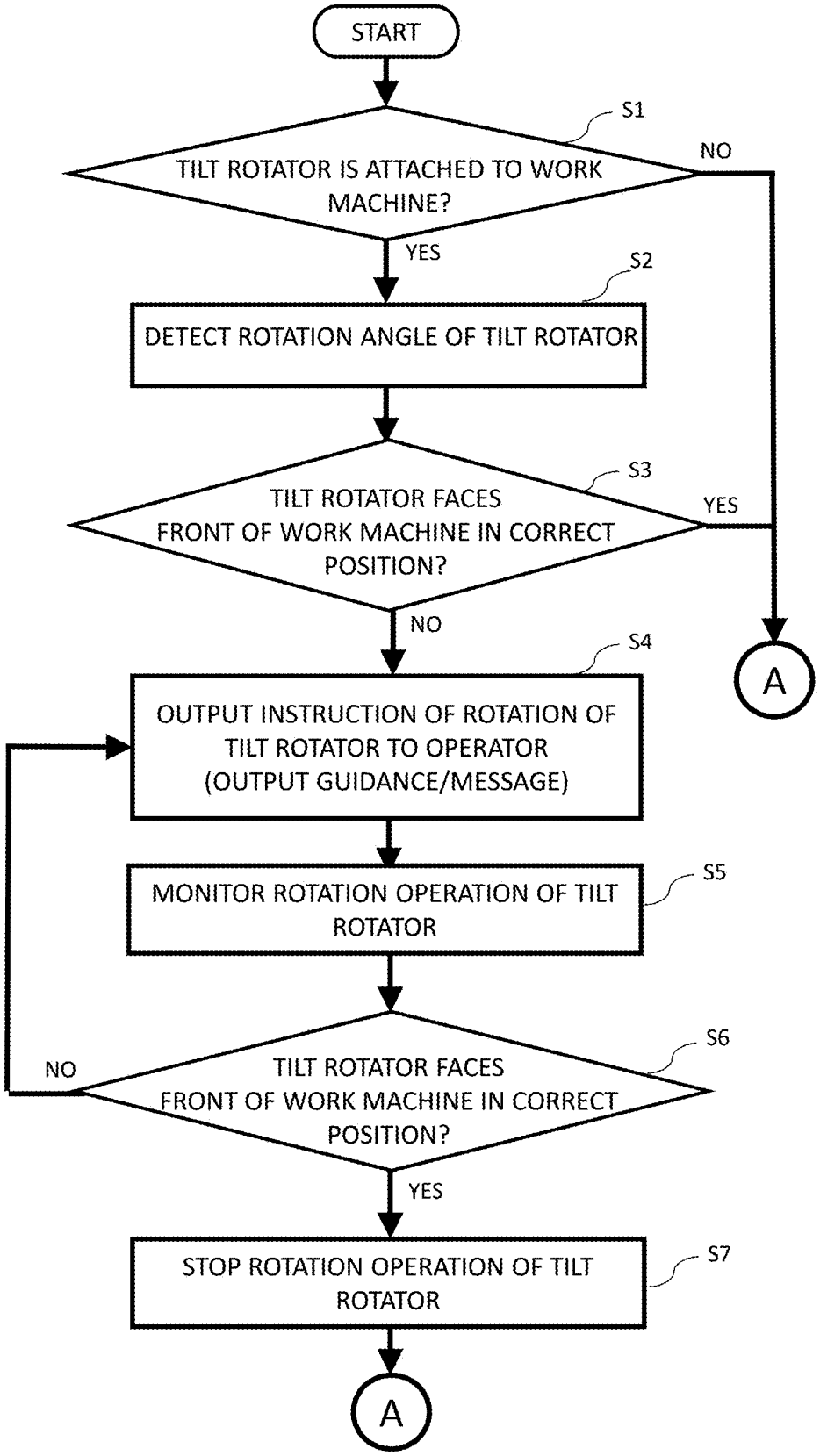
FIG. 6 is a flowchart of a method according to one or more embodiments of the disclosed subject matter.

FIG. 6 is a flowchart of a method of controlling a tilt rotator 40 to a correct position before attachment/detachment of the tool 15 from the quick coupler 50 according to one or more embodiments of the disclosed subject matter.

The process of controlling the tilt rotator 40 to the correct position may be initiated by the operator of the work machine 1 via the input unit 82, for instance, at end of certain work by the tool 15 at the work site and a replacement of the tool may be needed for next work. Alternatively, the process of controlling the tilt rotator 40 to the correct position may be initiated by the operator of the work machine 1 via the input unit 82, for instance, at beginning of transportation of the work machine 1. For instance, as one embodiment, the operator of the work machine 1 may input "command of coupler detachment/attachment" may be input from the operator of the work machine 1 by the switch 104 on the operator interface 103.

As shown in FIG. 6, the controller 88 may determine whether the tilt rotator 40 is attached to the work machine 1 (S1). In step S1, for example, the controller 88 may detect whether the tilt rotator 40 is attached to the work machine 1 by the sensor unit 87 as shown in FIG. 5. The controller 88 may start the step S1 in response to an instruction input from the operator via the input unit 82, which can instruct or command to start attachment or detachment of the tool 15 to or from the quick coupler 50.

Next, in the case where the determination of step S1 is YES, the controller 88 may detect the rotation angle 73 of the tilt rotator 40 (S2). More specifically, the controller 88 may start the detection of the rotation angle 73 of the tilt rotator 40 when the controller 88 receives input from the operator via the input unit 82. For example, the controller 88 may detect the rotation angle 73 of the tilt rotator 40 by the sensor unit 87 as shown in FIG. 5.

Figure 7:
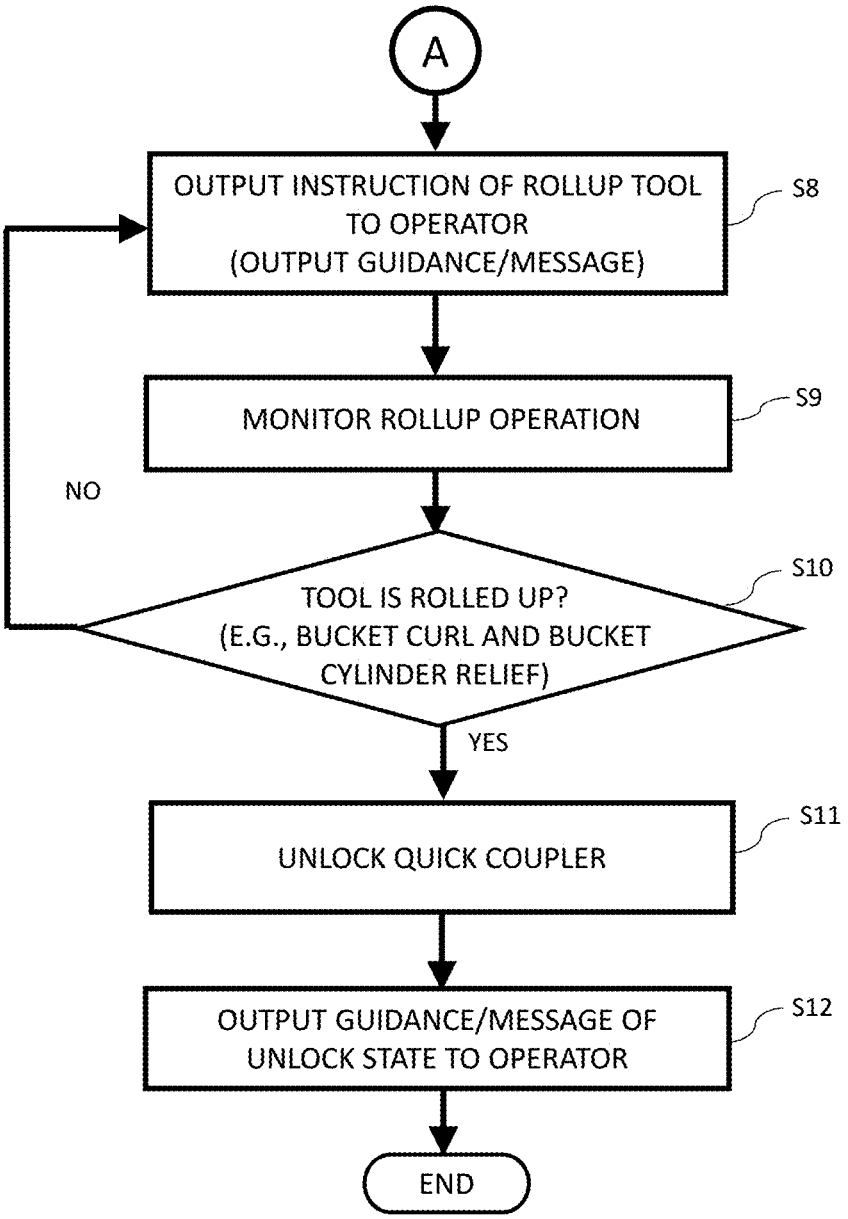
FIG. 7 is a flowchart of a method according to one or more embodiments of the disclosed subject matter.

On the other hand, in the case where the determination of step S1 is NO, i.e., the tilt rotator 40 is not attached to the work machine 1 by the sensor unit 87 as shown in FIG. 5, the processing may move on to step S8 of the processing shown in FIG. 7. Embodiments of the disclosed subject matter may include or be limited to only some or all of the operations of FIG. 6.

Next, the controller 88 can determine whether the tilt rotator 40 faces the front of the work machine 1 in the correct position, based on the detected rotation angle of the tilt rotator 40 (S3). In step S3, for example, the controller 88 may determine that the tilt rotator 40 faces the front of the work machine 1 in the correct position in the case where the detected rotation angle 73 of the tilt rotator 40 by the sensor unit 87 is equal to or less than a predetermined threshold (e.g., zero), as shown in FIG. 3A. Alternatively, as described above with FIG. 3B, the rotation angle 73 may be defined as the angle rotated from a plane which may be orthogonal to a forward running direction of the work machine 1, or a plane may be perpendicular to the boom 16 of the work machine 1, in the top plan view of the work machine 1.

Next, in the case where the determination of step S3 is NO, the controller 88 may output instruction of rotation of the tilt rotator 40 to the operator of the work machine 1 (S4). More specifically, the controller 88 may output guidance information or a message which indicates to perform rotation operation of the tilt rotator 40 to the operator, via the display unit 85, such as the monitor. Optionally or alternatively, the controller 88 may output the guidance information or the message which indicates to perform rotation operation of the tilt rotator 40 to the operator, via the audio unit 86, such as the speaker.

On the other hand, in the case where the determination of step S3 is YES, the processing may move on to step S8 of the processing shown in FIG. 7.

Optionally, in addition to detection of the rotation angle 73, the controller 88 may detect the tilt angle 76 of the tilt rotator 40 and may confirm that the tilt rotator 40 is not tilted as shown in FIG. 4A. More specifically, after the determination of step S3 (YES) and before step S8 shown in FIG. 7, the controller 88 may detect the tilt angle 76 of the tilt rotator 40 by the sensor unit 87 and determine whether the tilt rotator 40 is positioned in the correct position with respect to the tilt angle 76. For example, the tilt rotator 40 may be determined as to be in the correct position in a case where the detected tilt angle 76 of the tilt rotator 40 is equal to or less than a predetermined threshold (e.g., zero), such as shown in FIG. 4A. After determination of the tilt angle 76, the processing may move on to step S8 of the processing shown in FIG. 7.

Subsequently to step S4, in response to input of the rotation operation of the tilt rotator 40 provided by the operator via the input unit 82, the controller 88 may monitor the rotation operation of the tilt rotator 40 (S5). In step S5, the controller 88 may also detect the rotation angle 73 of the tilt rotator 40 continuously. Optionally, the controller 88 may control to display, on the display unit 85, virtual movements of the arm arrangement 30, the coupling arrangement 60 and the tool 15 in 3D space in synchronization with real-time movements of the arm arrangement 30, the coupling arrangement 60 and the tool 15, during the rotation operation of the tilt rotator 40 provided by the operator via the input unit 82.

Next, the controller 88 may determine whether the tilt rotator 40 faces the front of the work machine 1 in the correct position, based on the detected rotation angle 73 of the tilt rotator 40 (S6). In step S6, for example, the controller 88 may determine that the tilt rotator 40 faces the front of the work machine 1 in the correct position in the case where the monitored rotation angle 73 of the tilt rotator 40 by the sensor unit 87 is equal to or less than a predetermined threshold (e.g., zero), as shown in FIG. 3A. Alternatively, as described above with FIG. 3B, the rotation angle 73 may be defined as the angle rotated from a plane which may be orthogonal to a forward running direction of the work machine 1, or a plane may be perpendicular to the boom 16 of the work machine 1, in the top plan view of the work machine 1.

Next, in the case where the determination of step S6 is YES, the controller 88 may automatically stop the rotation operation of the tilt rotator 40 (S7). For example, the controller 88 may automatically control hydraulic system of the tilt rotator 40 to stop the rotation operation of the tilt rotator 40 without input indicating stop instruction from the operator via the input unit 82. In the embodiment, alternatively or optionally, the controller 88 may ignore instruction input or commands, from the operator, of further rotation operation of the tilt rotator 40, or may disable the further rotation operation of the tilt rotator 40.

As described above, generally, to stop the rotation operation of the tilt rotator 40 in the correct position by the operator with manual maneuvering input may not be accurate. Therefore, in this embodiment, the controller 88 may perform the step S7 instead of the operator to improve accuracy of the operation and safety of the work machine 1.

On the other hand, in the case where the determination of step S6 is NO, the processing may return to step S4 and continue the processing shown in steps S5 and S6 until the determination of step S6 turns YES.

Optionally or alternatively, in a case that the sensor unit 87 detects an error during detection of the rotation angle 73 and/or the tilt angle 76 shown in FIG. 6, the controller 88 may terminate the processing for safety of the work machine 1.

FIG. 7 is a flowchart of controlling rollup operation of the tool 15 for attachment/detachment of the quick coupler 50 according to one or more embodiments of the disclosed subject matter. The processing shown in FIG. 7 may be performed subsequently to the processing of stop of the rotation operation of the tilt rotator 40 (S7) described with reference to FIG. 6.

As shown in FIG. 7, the controller 88 may output instruction of rollup of the tool 15 to the operator of the work machine 1 (S8). More specifically, in step S8, the controller 88 may output guidance information or a message which indicates to perform rollup operation of the tool 15 to the operator, via the display unit 85, such as the monitor. Optionally or alternatively, the controller 88 may output the guidance information or the message which indicates to perform rollup operation of the tool 15 to the operator, via the audio unit 86, such as the speaker.

Subsequently to step S8, in response to input of the rollup operation of the tool 15 provided by the operator via the input unit 82, the controller 88 may monitor the rollup operation (S9). In step S9, the controller 88 may also detect position of the tool 15 continuously. Optionally, the controller 88 may control to display, on the display unit 85, virtual movements of the arm arrangement 30, the coupling arrangement 60 and the tool 15 in 3D space in synchronization with real-time movements of the arm arrangement 30, the coupling arrangement 60 and the tool 15, during the rollup operation provided by the operator via the input unit 82.

Next, the controller 88 may determine whether the tool 15 is in a final position (S10). For instances, in the case where the tool 15 is a bucket, the controller 88 may detect a position of the bucket and determine that the tool is in the final position ("rolled up") when the state of the bucket is "bucket curl" and "bucket cylinder relief" in step S10. Optionally or alternatively, the controller 88 may determine that the tool 15 is in the final position when the controller receives input from the operator via the input unit 82.

In the case where the determination of step S10 is NO, the processing may return to step S8 and continue the processing shown in steps S9 and S10 until the determination of step S10 turns YES.

Next, in the case where the determination of step S10 is YES, the controller 88 may perform unlocking of the quick coupler 50 (S11). By unlocking the quick coupler 50, a state of the quick coupler 50 may be transited to the unlock state from the lock state, and the tool 15 can be decoupled from the quick coupler 50 and replaceable by the operator. More specifically, the controller 88 may control the at least one locking actuator of the quick coupler 50, so that the tool 15 can be decoupled from the quick coupler 50 in the unlock state.

Next, the controller 88 may output guidance information or a message which indicates the unlock state of the quick coupler 50 to the operator (S12) and the processing may end. For instance, in step S12, the controller 88 may output the guidance information or the message which indicates the unlock state of the quick coupler 50 to the operator via the display unit 85, such as the monitor. Optionally or alternatively, the controller 88 may output the guidance information or the message which indicates the unlock state of the quick coupler 50 to the operator, via the audio unit 86, such as the speaker.

As a result, the operator can safely detach the tool 15 from the quick coupler 50 and/or attach new tool to the quick coupler 50 after the processing shown in FIGS. 6 and 7.

It is noted that embodiments of the disclosed subject matter are not limited to the specific arrangement of the processing steps as shown in FIGS. 6 and 7. For instance, embodiments of the disclosed subject matter can add more processing steps to control the tilt rotator 40 and the quick coupler 50 of the work machine 1.

Optionally or alternatively, in a case that the sensor unit 87 can detect an error during detection of the rotation angle 73, the controller 88 may skip the steps S2 to S10 and perform unlock the quick coupler 50 as shown in step S11. In that case, subsequently to step S11, the controller 88 may output an error message indicating the fault in addition to the guidance information or the message which indicates the unlock state of the quick coupler 50 to the operator in step S12.

Optionally or alternatively, in a case that adjustment of a position of the tool 15 may be required after step S12, the tilt rotator can be rotatable and/or tiltable in a low speed mode. Embodiments of the disclosed subject matter may include or be limited to only some or all of the operations of FIG. 7.

Thus, according to embodiments of the disclosed subject matter, a work machine can comprise a tilt rotator to control rotation of a tool about a rotational axis and to control tilt of the tool about a tilt axis, a coupler to couple and decouple the tool to/from the tilt rotator, a display to output information to an operator of the work machine, an operator interface to receive input from the operator, and processing circuitry. The processing circuitry is configured to output, on the display, a rotation instruction for the operator to initiate a rotation operation of the tilt rotator, in a case that the tilt rotator is determined to be in an incorrect position based on a rotation angle of the tilt rotator about the rotational axis, stop the rotation operation of the tilt rotator under a condition that the tilt rotator is determined to be in a correct position based on the rotation angle of the tilt rotator about the rotational axis, the rotation operation being initiated by a rotation input via the operator interface, output, on the display, a rollup instruction for the tool to initiate a rollup operation.

The work machine can detect the rotation angle of the tilt rotator in response to instruction of detachment of the tool from the coupler, via the operator interface. Optionally, the operator interface may be mounted on a joystick of the work machine.

Moreover, the work machine can determine that the tilt rotator is in the correct position when the rotation angle of the tilt rotator is equal or less than a predetermined threshold (e.g., zero).

Here, the rotation angle may be an angle between a face of the tool and a front surface of a body of the work machine in a top plan view of the work machine.

Furthermore, the work machine can determine that the tilt rotator is in the correct position when the face of the tool and the front surface of the body of the work machine are arranged in parallel in the top plan view of the work machine.

Optionally, the work machine can detect a tilt angle of the tilt rotator in advance to detecting the rotation angle of the tilt rotator, and control the tilt angle of the tilt rotator to be less than a predetermined threshold (e.g., zero). The tilt angle may be an angle of a top surface of the tool from a horizontal plane in a front view of the work machine.

Optionally, the work machine can display, on the display, virtual movements of the tilt rotator and the tool in 3D space in synchronization with real-time movements of the tilt rotator and the tool during the rotation operation.

Optionally, the work machine can display, on the display, virtual movements of the tilt rotator and the tool in 3D space in synchronization with real-time movements of the tilt rotator and the tool during the rollup operation.

Optionally, the work machine can detect an end of the rollup operation of the tool and output, on the display, information of an unlock state of the coupler which indicates that the tool is detachable from the coupler.

With these features, the work machine can guide the operator of the work machine to initiate rotation operation and rollup operation at an appropriate point respectively, and control to stop the rotation operation automatically. Thus, embodiments of the disclosed subject matter can increase safety and work efficiency of the work machine.

According to the embodiments, it is possible to control a series of processing of rotation operation of the tilt rotator and rollup operation of the tool by guiding the operator's operation appropriately, in addition to automatically performed operation.

In another aspect, a method for a work machine is disclosed or implemented. The method can comprise detecting a rotation angle of a tilt rotator, the tilt rotator controlling rotation of a tool about a rotational axis and controlling tilt of the tool about a tilt axis; outputting, on the display, a rotation instruction for the operator to initiate a rotation operation of the tilt rotator, in a case that the tilt rotator is determined to be in an incorrect position based on a rotation angle of the tilt rotator about the rotational axis; and stopping the rotation operation of the tilt rotator under a condition that the tilt rotator is determined to be in a correct position based on the rotation angle of the tilt rotator about the rotational axis, the rotation operation being initiated by a rotation input via the operator interface.

And in another aspect a control system is disclosed or provided. The control system can comprise circuitry configured to detect a rotation angle of a tilt rotator, the tilt rotator controlling rotation of a tool about a rotational axis and controlling tilt of the tool about a tilt axis, output rotation instruction of the tilt rotator on a display, in a case that the tilt rotator is determined to be in an incorrect position based on the rotation angle of the tilt rotator, detect rotation operation of the tilt rotator, in response to a rotation input via an operator interface, automatically stop the rotation operation of the tilt rotator in a case that the tilt rotator is determined to be in a correct position based on the rotation angle of the tilt rotator, and output rollup instruction of the tool on the display.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A work machine comprising:

a tilt rotator to control rotation of a tool about a rotational axis and to control tilt of the tool about a tilt axis;

a coupler to couple and decouple the tool to/from the tilt rotator;

a display to output information to an operator of the work machine;

an operator interface to receive input from the operator; and processing circuitry configured to output, on the display, a rotation instruction for the operator to initiate a rotation operation of the tilt rotator, in a case that the tilt rotator is determined to be in an incorrect position based on a rotation angle of the tilt rotator about the rotational axis, stop the rotation operation of the tilt rotator under a condition that the tilt rotator is determined to be in a correct position based on the rotation angle of the tilt rotator about the rotational axis, the rotation operation being initiated by a rotation input via the operator interface, and output, on the display, a rollup instruction for the operator to initiate a rollup operation of the tool.

2. The work machine according to claim 1, wherein the processing circuitry is configured to detect the rotation angle of the tilt rotator in response to instruction of detachment of the tool from the coupler, via the operator interface.

3. The work machine according to claim 1, wherein the processing circuitry is configured to determine that the tilt rotator is in the correct position when the rotation angle of the tilt rotator is equal to or less than a predetermined threshold.

4. The work machine according to claim 3, wherein the rotation angle is an angle between a face of the tool and a front surface of a body of the work machine in a top plan view of the work machine.

5. The work machine according to claim 4, wherein the processing circuitry is configured to determine that the tilt rotator is in the correct position when the face of the tool and the front surface of the body of the work machine are arranged in parallel in the top plan view of the work machine.

6. The work machine according to claim 1, wherein the processing circuitry is further configured to detect a tilt angle of the tilt rotator, and control the tilt angle of the tilt rotator to be equal to or less than a predetermined threshold.

7. The work machine according to claim 6, wherein the tilt angle is an angle of a top surface of the tool from a horizontal plane in a front view of the work machine.

8. The work machine according to claim 1, wherein the processing circuitry is configured to display, on the display, virtual movements of the tilt rotator and the tool in 3D space in synchronization with real-time movements of the tilt rotator and the tool during the rotation operation.

9. The work machine according to claim 1, wherein the processing circuitry is configured to display, on the display, virtual movements of the tilt rotator and the tool in 3D space in synchronization with real-time movements of the tilt rotator and the tool during the rollup operation.

10. The work machine according to claim 1, wherein the operator interface is mounted on a joystick of the work machine.

11. The work machine according to claim 1, wherein the processing circuitry is configured to detect an end of the rollup operation of the tool; and output, on the display, information of an unlock state of the coupler which indicates that the tool is detachable from the coupler.

12. A method for a work machine comprising:

detecting a rotation angle of a tilt rotator, the tilt rotator controlling rotation of a tool about a rotational axis and controlling tilt of the tool about a tilt axis;

outputting, on a display, a rotation instruction for an operator to initiate a rotation operation of the tilt rotator, in a case that the tilt rotator is determined to be in an incorrect position based on the rotation angle of the tilt rotator about the rotational axis; and stopping the rotation operation of the tilt rotator under a condition that the tilt rotator is determined to be in a correct position based on the rotation angle of the tilt rotator about the rotational axis, the rotation operation being initiated by a rotation input via an operator interface.

13. The method according to claim 12, further comprising:

outputting, on the display, a rollup instruction for the tool to initiate a rollup operation;

stopping the rollup operation under a condition that the tool is determined to be in a final position, the rollup operation being initiated by a rollup input via the operator interface; and unlocking a coupler, the coupler coupling and decoupling of the tool and the work machine; and outputting, on the display, information of an unlock state of a coupler which indicates that the tool is detachable from the coupler.

14. The method according to claim 12, further comprising:

determining that the tilt rotator is in the correct position when the rotation angle of the tilt rotator is equal or less than a predetermined threshold.

15. The method according to claim 14, wherein the rotation angle is an angle between a face of the tool and a front surface of a body of the work machine in a top plan view of the work machine.

16. The method according to claim 15, further comprising:

determining that the tilt rotator is in the correct position when the face of the tool and the front surface of the body of the work machine are arranged in parallel in the top plan view of the work machine.

17. The method according to claim 12, further comprising:

rotating the tilt rotator until the tilt rotator is positioned in the correct position based on continuous input from the operator interface, after the rotation operation being initiated by the rotation input via the operator interface.

18. The method according to claim 12, further comprising:

displaying, on the display, virtual movements of the tilt rotator and the tool in 3D space in synchronization with real-time movements of the tilt rotator and the tool during the rotation operation.

19. The method according to claim 12, further comprising:

displaying, on the display, virtual movements of the tilt rotator and the tool in 3D space in synchronization with real-time movements of the tilt rotator and the tool during the rollup operation.

20. A control system comprising:

circuitry configured to detect a rotation angle of a tilt rotator, the tilt rotator controlling rotation of a tool about a rotational axis and controlling tilt of the tool about a tilt axis;

output rotation instruction of the tilt rotator on a display, in a case that the tilt rotator is determined to be in an incorrect position based on the rotation angle of the tilt rotator;

detect rotation operation of the tilt rotator, in response to a rotation input via an operator interface;

automatically stop the rotation operation of the tilt rotator in a case that the tilt rotator is determined to be in a correct position based on the rotation angle of the tilt rotator; and output rollup instruction of the tool on the display.

* * * * *